United States Patent [19]

Ivanoff

[11] Patent Number: 4,491,004

[45] Date of Patent: Jan. 1, 1985

[54] APPARATUS FOR MANUFACTURING A METAL PIPE

[76] Inventor: Osmo O. Ivanoff, Satamakatu 7 A 4, SF-33200 Tampere 20, Finland

[21] Appl. No.: 373,505

[22] PCT Filed: Aug. 18, 1981

[86] PCT No.: PCT/FI81/00066

§ 371 Date: Apr. 16, 1982

§ 102(e) Date: Apr. 16, 1982

[87] PCT Pub. No.: WO82/00607

PCT Pub. Date: Mar. 4, 1982

[30] Foreign Application Priority Data

Aug. 18, 1980 [FI] Finland ..... 802596

[51] Int. Cl.[3] ..... B21D 5/14; B21C 37/08

[52] U.S. Cl. ..... 72/168; 72/169; 72/171; 72/213; 72/389; 72/466

[58] Field of Search ..... 72/51, 169, 170, 171, 72/173, 175, 212, 213, 389, 412, 368, 465, 466, 168

[56] References Cited

U.S. PATENT DOCUMENTS

| | | | |
|---|---|---|---|
| 241,309 | 5/1881 | Davis et al. | 72/212 |
| 1,804,468 | 5/1931 | Jensen | 72/171 |
| 1,941,953 | 1/1934 | Pump | 72/368 X |
| 2,426,260 | 8/1947 | Courtney | 72/213 |
| 2,491,655 | 12/1949 | Georg | 72/171 |
| 2,882,767 | 4/1959 | Chatfield | 72/171 |
| 2,908,315 | 10/1959 | Hellwig | 72/213 X |
| 3,091,279 | 5/1963 | O'Neill | 72/171 |
| 3,103,965 | 9/1963 | Savory | 72/173 X |
| 3,319,452 | 5/1967 | Rethwish et al. | 72/465 X |
| 3,564,889 | 2/1971 | Herburg | 72/175 X |
| 3,693,391 | 9/1972 | Mori | 72/173 |
| 3,845,655 | 11/1974 | Krieg | 72/389 |
| 4,192,170 | 3/1980 | Ferwagner | 72/368 X |

FOREIGN PATENT DOCUMENTS

| | | | |
|---|---|---|---|
| 112324 | 2/1929 | Austria | 72/169 |
| 274721 | 5/1914 | Fed. Rep. of Germany . | |
| 332291 | 1/1921 | Fed. Rep. of Germany | 72/173 |
| 339345 | 7/1921 | Fed. Rep. of Germany . | |
| 420013 | 10/1925 | Fed. Rep. of Germany . | |
| 428482 | 5/1926 | Fed. Rep. of Germany | 72/169 |
| 633683 | 7/1936 | Fed. Rep. of Germany . | |
| 1007280 | 5/1957 | Fed. Rep. of Germany . | |
| 1073425 | 1/1960 | Fed. Rep. of Germany . | |
| 1085839 | 7/1960 | Fed. Rep. of Germany . | |
| 1086658 | 8/1960 | Fed. Rep. of Germany . | |
| 1118127 | 11/1961 | Fed. Rep. of Germany . | |
| 1124905 | 3/1962 | Fed. Rep. of Germany . | |
| 51-18253 | 2/1976 | Japan | 72/368 |
| 770602 | 10/1980 | U.S.S.R. | 72/389 |

*Primary Examiner*—E. Michael Combs

*Attorney, Agent, or Firm*—Andrus, Sceales, Starke & Sawall

[57] ABSTRACT

The invention relates to an apparatus for manufacturing a metal pipe. At present, accurately measured, thick-walled pipes to be used as rolls must be manufactured in a plurality of working steps. The manufacture of pipes of accurate diameters is complicated e.g. due to inner stresses in pipe blanks which results in deformations in internal or external machining of pipes. An object of the present invention is to overcome the drawbacks of the prior art. According to the invention a metal sheet is bent into the shape of a pipe by applying to said sheet a bending force perpendicularly to the sheet along a longitudinal line of action (a) in the sheet by means of a bending tool (2), said sheet being supported on a support tool (3) along two support lines (b, c) parallel to said line of action which lies between said support lines, the sheet being laterally displaced, so that the bending line and support lines move along the sheet in its lateral direction, and that the edges of said sheet are bent against each other and welded together. Said sheet (1) may be bent by means of a bending roll (4) against two support rolls (5, 5'). The apparatus of the invention consists of a bending tool (2) e.g. comprising a bending roll (4), and a support tool (3), e.g. two parallel rotatable support rolls (5, 5') supported at a distance from each other, wherein bending roll is parallel to said support rolls and can be moved towards the support rolls by means of an actuator (11).

2 Claims, 7 Drawing Figures

APPARATUS FOR MANUFACTURING A METAL PIPE

The present invention relates to a method of manufacturing a metal pipe or the like. The invention further relates to an apparatus for manufacturing a metal pipe or the like from a metal sheet.

BACKGROUND OF THE INVENTION

At present, there is no method available for the manufacture of accurately measured lengthy pipes of great diameter in one working step. Similarly, accurately measured, thick-walled pipes to be used as rolls must be manufactured in a plurality of working steps, such as welding and lathing of the pipe. In the presently known methods, the manufacture of pipes of accurate diameters is complicated, e.g. due to inner stresses in pipe blanks; internal or external machining of pipes of accurately measured diameters results in deformations.

SUMMARY OF THE INVENTION

An object of the present invention is to overcome the above drawbacks. The object of the invention is especially to provide a novel method and apparatus which are particularly suitable for the manufacture of pipes having accurate diameters and for the calibration effected simultaneously with manufacturing.

For the characterizing features of the invention, reference is made to the accompanying claims.

DESCRIPTION OF THE DRAWINGS

The invention will be described in more detail hereinafter with reference made to the accompanying drawings, in which.

DESCRIPTION OF PREFERRED EMBODIMENT

Figure 1:
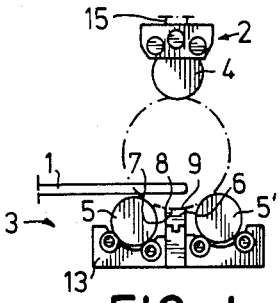
FIGS. 1–5 illustrate manufacturing of a pipe by the method of the invention, the pipe being shown in end view.
Figure 2:
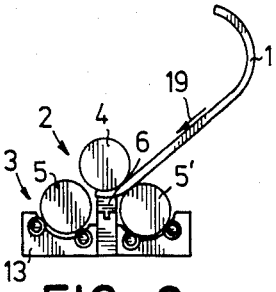
Figure 3:
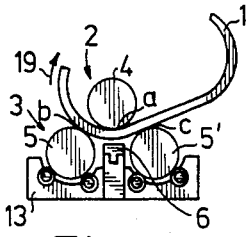

FIGS. 1–5 show the bending of a standard width metal sheet into a pipe by means of the method of the invention. In FIG. 3 the bending of a metal sheet 1 is in progress. Said metal sheet 1 is positioned upon a supporting tool 3, so that the sheet is supported on said tool along two parallel and straight support lins b, c, i.e. contact points between the metal sheet and the support tool form said parallel support lines (in perpendicular direction to the plane of the drawing sheet). Bending is effected by applying to sheet 1 a bending force perpendicularly to the sheet along a longitudinal straight line of action a of the sheet, i.e. along the straight line formed by the contact points between a bending tool and sheet surfaces, said bending force being applied by means of a bending tool 2. The line of action a of said bending tool lies between the support lines b, c of said support tool 3, said bending tool thus bending the sheet along the line action between the support lines. At the same time the sheet is conveyed in its lateral direction, i.e. in the direction of an arrow 19, the sheet thus bending into the shape of a pipe jacket. In FIG. 1 the bending of sheet 1 is just beginning for the forward edge of the sheet, in FIG. 2 the bending has proceeded into a nearly semi-circular shape for the forward edge of the sheet and the bending of the trailing edge is just beginning, in FIG. 3 the sheet bending is just nearing its end for the trailing edge of the sheet, in FIG. 4 the bending has been finished also for the trailing edge, and on FIG. 5 the sheet edges are urged against each other for a continuous pipe profile 1', shown by dashed lines in FIG. 5.

In FIGS. 1–5 the bending tool 2 comprises a roll 4 rotatably journalled on a top bracket 15 which is movable by means of an actuator. Accordingly, the support tool 3 comprises two support rolls 5, 5' which are rotatably journalled on a base structure 13. Rolls 4, 5, 5' are parallel and aligned with each other with bending rolls above the support rolls between the latter. Further in the embodiment of FIGS. 1–5, the apparatus is provided with a lengthwise extending support member 6 which is parallel to rolls 4, 5, 5' and positioned between the support rolls and whose upper edge has formed therein a groove 7 parallel to the rolls and defined by edges 8, 9. The support member can be lifted and lowered by means of an actuator (not shown in the figure) and, in the example of FIG. 2, bending of the sheet begins on the top of said groove, the bending tool bending the sheet into the shape of a cylinder jacket against the groove in said support member.

Figure 5:
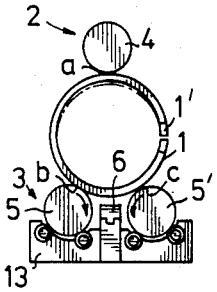
Figure 6:
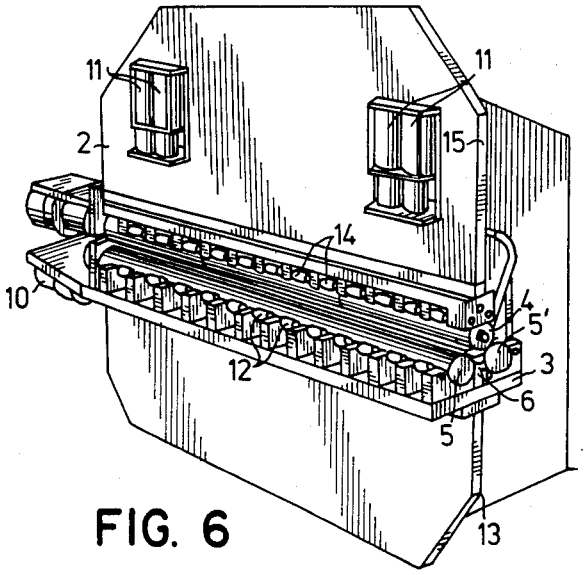
FIG. 6 is a perspective view of an apparatus according to one embodiment of the invention for carrying out the method.

FIG. 5 shows the last step of the pipe bending, i.e. edges of the sheet are urged against each other. Thereafter, said edges of the sheet are welded together for a continuous jacket surface. Welding can be effected on support rolls 5, 5' and this can be followed by cold rolling the pipe 1' at its shaping temperature between the support rolls and the bending roll, said rolls working as rolling tools for a smooth and stretched pipe surface. Calibration of the pipe is effected at the same time. The inner face of the pipe can be machined by means of a roll to be disposed inside the pipe. By virtue of the machining of the pipe surface, the inner stresses of the pipe will convert into the direction of the periphery and improve possibilities of using the pipe as high-speed rolls and accurately measured pipes. FIG. 6 shows completely the apparatus for carrying out the method illustrated in FIGS. 1–5; the design of the apparatus of FIG. 6 completely corresponds to the apparatus shown in FIGS. 1–5. Support rolls 5, 5' are fitted on spring rollers 12, rolls 5, 5' are each resting on two rows of spring rollers with the roll axes parallel to each other. Spring rollers are mounted on the base 12. Corresponding to the installation of support rolls, the bending roll 4 is supported in overhead manner by means of spring roller 14 on a top bracket 15 movable with respect to the base 12 in up-and-down direction by means of actuators 11, such as hydraulic cylinders. In the bending step, the rollers springed to the top bracket 15 are urged to the bottom and the bending roll 4 provides, together with the top bracket, a fixed and solid bending tool. Corresponding to the operation of the bending tool, rolls 5, 5' of the support tool are urged with respect to the base 13 against their solid arched mounting beds, thus providing a fixed support tool for the bending step.

The spring forces of spring rollers 12, 14 of said bending and support tools 2, 3 are selected to be adjusted according to weights of the sheets, so that during the transfer the sheet will stay in roller contact and only in the compression step is urged into intimate contact with the tools themselves.

In the embodiment shown in FIGS. 1–6, the support rolls 5, 5' of said support tool 3 are fitted with hydraulic motors for rotation of the rolls and transfer of the sheet between the bending tool and the support tool.

Figure 7:
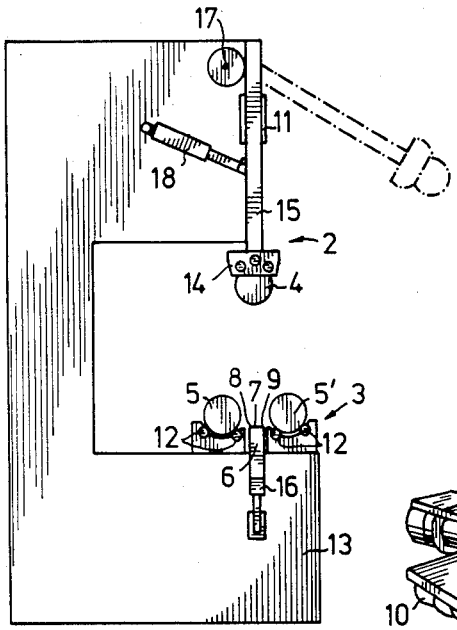
FIG. 7 is similar to FIGS. 1–5 showing an apparatus according to another embodiment for the manufacture of a pipe.
Figure 4:
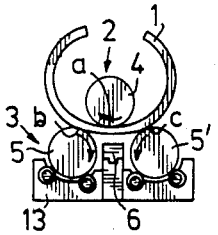

The apparatus shown in FIG. 7 comprises a top bracket 15 which can be pivoted against the base 13 by means of a hydraulic cylinder 18 with the assistance of a link 17. When using the apparatus of FIG. 7 for bending a sheet into the shape of a pipe, the bending tool 3 gets partially inside the pipe between the edges thereof. When the pipe diameter is smaller, the resulting blank can be removed underhand after the top bracket has been sufficiently pivoted. Larger cylinders can be pulled through the gap of the apparatus.

The apparatus of FIG. 7 is provided with an actuator and/or spring means 16 for lifting as well as springing of a support member 6 disposed between rolls 5, 5' of the support tool 3.

The method of the invention is applicable to the cold manufacture of pipes and cylinder profiles, i.e. at normal room temperature. If so desired, the blanks can be heated when necessary.

With the method of the invention, it is possible to perform all usual rounding jobs of sheets which, up to now, have required a separate sheet rounding machine. Furthermore, the method provides for convenient and quick manufacture of small-diametered, thick-walled and lengthy roll tubes and special pipes requiring great accuracy. The same machine can be used for releasing pipe stresses in such a manner that the overhead bending tool is disengaged and the pipe is rotated on the lower rolls and pressed with special tools, so that the pipe deforms with every pressing. Such overall working of the pipe will neutralize tension of the crystal structure and the roundness of the pipe can be so calibrated that, e.g. internal or external lathing does not result in pipe deformations.

If necessary, the above apparatus embodiments can be provided with a sufficiently large gap and bend compensation systems as well as with servo-hydraulic control, resulting in pipe manufacturing tolerance which is better than those available at present.

The method and apparatus of the invention are also applicable to the manufacture of accurate profiles. The sheet transfers required for this can be effected by means of the rotating rolls of the support tool without the assistance of manpower and cranes.

The above examples are only intended to illustrate the invention without limiting it in any way.

I claim:

1. An apparatus for fabricating a tubular article from a metal sheet, comprising a base, a top support mounted for movement with respect to said base, a support tool mounted on the base and comprising at least two spaced parallel rotatable support rolls, bending tool means mounted on said top support and comprising at least one bending roll disposed parallel to said support rolls, drive means for moving a metal sheet between said bending roll and said support rolls in a direction transverse to the longitudinal dimension of said rolls wherein said metal sheet is bent into tubular shape by applying a bending force through said bending roll along a longitudinal line located between said support rolls, first spring roller means supporting said bending roll from said top support, second spring roller means for mounting each of said support rolls with respect to said base, said first and second spring roller means permitting rotation of said rolls and corresponding transverse movement of said sheet, means for applying a force to said bending roll sufficient magnitude to overcome the force of said first and second spring means and provide a rigid mounting for both said support rolls and said bending roll during the bending operation to bend said sheet to form said tubular article, and actuator means for moving said bending roll into contact with the outer surface of said tubular article whereby the article is supported for rotation for subsequent processing by said support rolls and said bending roll.

2. The apparatus of claim 1, and including a support member disposed between the support rolls and aligned with said bending roll and having a generally concave upper surface against which the edge portion of said sheet is bent, said support member being constructed and arranged to be moved in a direction away from said bending roll to a position out of engagement with the tubular article to enable said article to be supported for rotation solely by said support rolls and said bending roll.

* * * * *

UNITED STATES PATENT AND TRADEMARK OFFICE

CERTIFICATE OF CORRECTION

PATENT NO. : 4,491,004

DATED : January 1, 1985

INVENTOR(S) : OSMO O. IVANOFF

It is certified that error appears in the above-identified patent and that said Letters Patent is hereby corrected as shown below:

Col. 4, Line 25, CLAIM 1, After "roll" insert ---of---

Signed and Sealed this

*Twenty-seventh* Day of *August 1985*

[SEAL]

*Attest:*

DONALD J. QUIGG

*Attesting Officer* *Acting Commissioner of Patents and Trademarks*